United States Patent [19]

Nelson

[11] Patent Number: 4,662,580

[45] Date of Patent: May 5, 1987

[54] SIMPLE DIVER REENTRY METHOD

[75] Inventor: Robert L. Nelson, Los Altos Hills, Calif.

[73] Assignee: The United States of America as represented by the Secretary of the Navy, Washington, D.C.

[21] Appl. No.: 746,682

[22] Filed: Jun. 20, 1985

[51] Int. Cl.[4] ..... F42B 15/02

[52] U.S. Cl. ..... 244/3.1; 244/3.21

[58] Field of Search ..... 244/3.21, 3.15, 3.1

[56] References Cited

U.S. PATENT DOCUMENTS

| | | | |
|---|---|---|---|
| 2,821,349 | 1/1958 | Sohn | 244/14 |
| 2,979,284 | 4/1961 | Genden et al. | 244/14 |
| 3,990,657 | 11/1976 | Schott | 244/3.15 |
| 3,998,409 | 12/1976 | Pistiner | 244/165 |
| 4,277,038 | 7/1981 | Yates et al. | 244/3.15 |
| 4,456,202 | 6/1984 | Price, Jr. et al. | 244/3.15 |
| 4,577,812 | 3/1986 | Platus | 244/3.21 |

*Primary Examiner*—Charles T. Jordan

*Attorney, Agent, or Firm*—R. F. Beers; C. D. B. Curry; W. C. Daubenspeck

[57] ABSTRACT

A method for compensating for pre-reentry errors generated by the weapon delivery system to provide a reduced impact range error dispersion over that provided by a ballistic trajectory after reentry comprising maneuvering the reentry body after reentry so that the terminal flight direction is essentially in line with the line of means of the reentry body's position-error ellipse that exists just prior to reentry. The reentry body trajectory follows a sequence of a ballistic leg from reentry, a dive maneuver including an optional pullup leg and a pulldown leg to establish the required terminal direction, and a terminal ballistic leg to impact. The required maneuvering is accomplished by modulating the aerodynamic lift of the reentry body by controlling the reentry body's roll orientation.

9 Claims, 9 Drawing Figures

18 LINE OF DOWNRANGE MEANS
12
14
$\Delta x_0$
$\Delta h_0$
$\theta_E$
20
12
14
18
10
400K
ALTITUDE (FT)
RANGE
16
22
26
BALLISTIC ERROR 24
DIVER ERROR 28

16
32
12
30
100K
ALTITUDE (FT)
RANGE

SIMPLE DIVER REENTRY METHOD

BACKGROUND OF THE INVENTION

This invention relates in general to compensating for errors in the trajectory of reentry bodies and, in particular, to a method for compensating for such errors which utilizes a maneuvering reentry body. It is well known that the theoretical trajectory of ballistic missiles can be predetermined with great accuracy. Consequently, the so-called "nominal" position of the missile at any time in flight following booster burnout can be predicted. However, because of errors generated by the weapon delivery system, the standard deviation of the weapon system delivery dispersion at nominal reentry time is described in the trajectory plane by the inclined ellipse. Conventional fuzing subsystems utilize combinations of impact fuzing, fuzing at a radar measured altitude, and fuzing at a predetermined time after encountering a given longitudinal deceleration level. With these fuzing techniques, the dispersion ellipse is propagated along the trajectory to yield an elongated downrange-cross-range ellipse at the fuzing location. The downrange dispersion caused by errors generated in the weapon delivery system limits the predictable effectiveness of the ballistic reentry body upon target.

One approach for reducing the downrange errors generated in the delivery system is described in U.S. Pat. No. 3,990,657. In this approach, the downrange error is reduced by determining the altitude error from the nominal at a particular time during flight, computing a position error from this altitude error, and then maneuvering the reentry body in flight to return the reentry body to its nominal trajectory. In a second approach, described in U.S. Pat. No. 4,456,202, the deviation from the nominal trajectory is also detected by in-flight measurements. In this approach, however, the fuzing location is adjusted to compensate for the error in trajectory. Both approaches require an on-board radar for measuring the altitude of the reentry body.

SUMMARY OF THE INVENTION

It is an object of the present invention to increase the predictable effectiveness of the reentry body upon the intended target.

Another object is to compensate for errors generated in the weapon delivery system that occur prior to reentry.

A further object is to compensate for these weapon system delivery errors without a requirement for on-board sensing of the errors by the reentry body.

Another object is to provide improved accuracy while minimizing cost and complexity and employing flight-demonstrated technology.

These and other objects are provided by a reentry trajectory employing a maneuverable reentry body. In the present invention, the reentry body is required to turn its flight path prior to impact so that the terminal flight direction is essentially in line with the line of means of the reentry body's position-error ellipse that exists just prior to reentry. The reentry body trajectory follows a sequence of a ballistic leg from reentry, a dive maneuver including an optional pullup leg and a pull-down leg to establish the required terminal direction, and a terminal ballistic leg to impact. The required maneuvering is accomplished by modulating the aerodynamic lift of the reentry body by controlling the reentry body's roll orientation.

The advantages, and features of the present invention will become apparent from the following detailed description of the invention when considered in conjunction with the accompanying drawings wherein:

DESCRIPTION OF THE PREFERRED EMBODIMENT

Figures 1, 1A, 2:
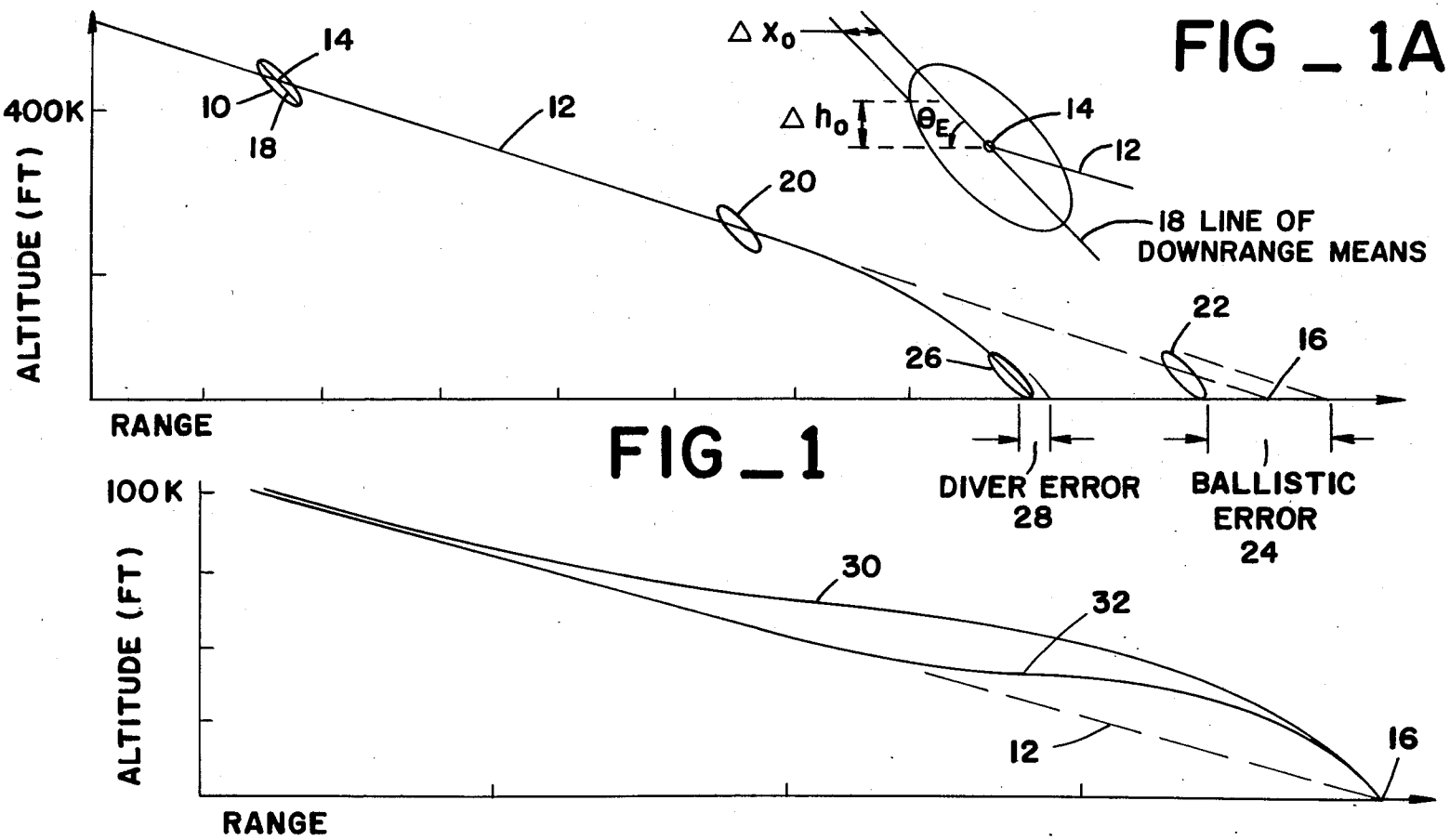
FIGS. 1 and 1*a* illustrated the accuracy of the simple diver reentry trajectory in comparison with the accuracy of a ballistic trajectory.
FIG. 2 illustrates two typical simple diver maneuvers.

Referring now to the drawings and, in particular to FIGS. 1 and 1*a* the inclined ellipse 10 represents the weapon system delivery error distribution in the trajectory plane just prior to reentry into the atmosphere (e.g. approximately 400,000 feet altitude) with the nominal ballistic trajectory represented by line 12 from the nominal reentry location 14 to the nominal ballistic impact location 16. As best seen in FIG. 1*a*, the deliver error is assumed to be along the line of downrange means (LOM) 18 which is defined by the locus of the midpoint of the downrange dispersion ($\Delta X_o$) at each altitude slice ($\Delta h_o$) through the inclined ellipse 10. The LOM 18 is represented by a line through the center of the error ellipse 10 inclined at an angle $\theta_E$ with the horizontal. Ellipses 20 and 22 represent the position-error ellipse as it is propagated along the ballistic trajectory 12 to produce a ballistic body impact range error dispersion 24.

In the simple diver reentry method, the reentry body is required to turn its flight path (i.e. dive) prior to impact so that the terminal flight direction is essentially in line with the LOM 18 of the reentry body's position error ellipse that exists just prior to reentry. Ellipse 26 represents the position error ellipse for a reentry body having a terminal flight direction in line with the LOM 18 of the reentry body's position error ellipse 10. The range error in the trajectory plane is then reduced to that shown at 28.

As shown in the diver trajectory of FIG. 1 and trajectories 30 and 32 in FIG. 2, the reduced error dispersion may be accomplished by a reentry body trajectory following a sequence of a ballistic leg from reentry, a dive maneuver including a pullup leg (as in trajectories 30 and 32) if required to reach the aim point and a pull-down leg, and a terminal ballistic leg in the prescribed direction. The degree of accuracy improvement over the pure ballistic path is dependent on the pre-entry error ellipse properties which are set by the missile guidance, launch-platform navigation, and depolyment capabilities.

The preferred implementation of the diver trajectory uses aerodynamic lift of the reentry body to accomplish the required maneuver so that positive control is not required. To accomplish the maneuver using aerodynamic lift requires that navigation of the reentry body be initiated out of the atmosphere at a nominal time and altitude. The dive maneuver is then initiated at a measured distance from the "start" condition. Initiating the dive at a prescribed time deep in the atmosphere is not as advantageous since the ellipse as a function of time rotates to the horizontal and flattens from aerodynamic drag effects. For the dive trajectory of FIG. 1, impact occurs at a specified distance from the ballistic aim point. The reentry trajectory must include a terminal ballistic leg of at least the length of the semimajor axis of the pre-entry ellipse. This insures that the leading edge of the ellipse is coincident with the target. Inclusion of a pullup leg as in trajectories 30 and 32 of FIG. 2 will bring the diver impact back to the ballistic impact point eliminating the need for a diver impact offset in missile fire control.

Figure 3:
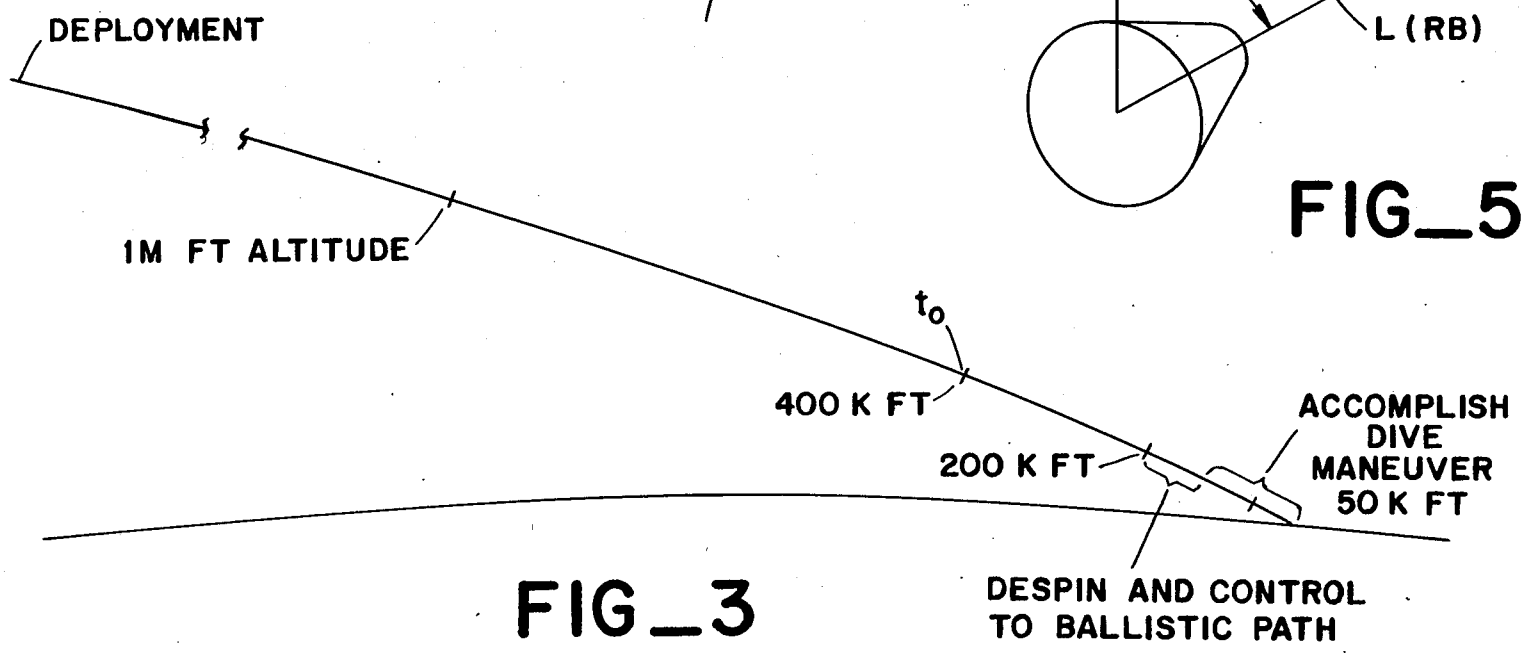
FIG. 3 is a trajectory profile useful in describing key events in a typical diver reentry trajectory.
Figure 4:
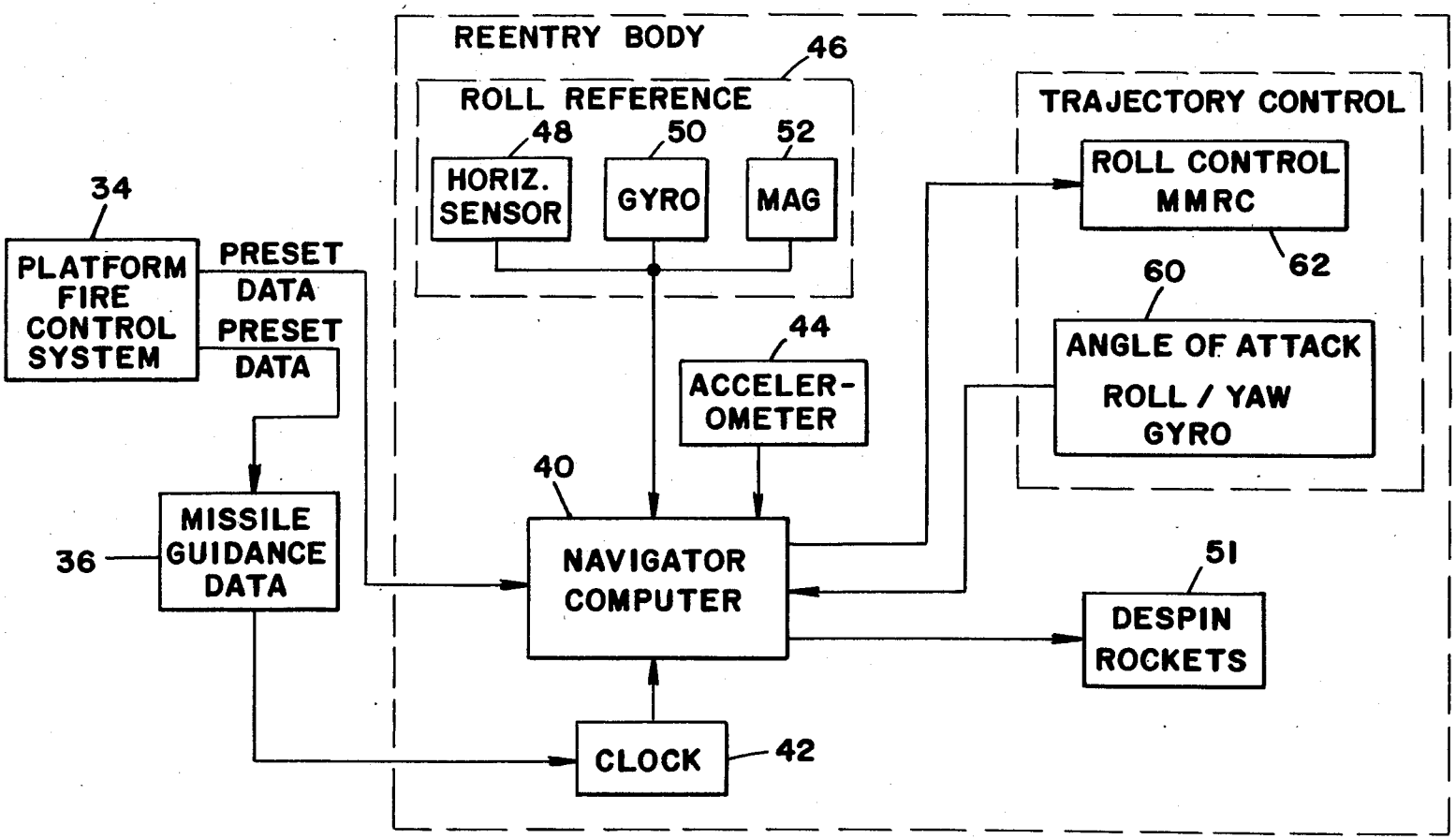
FIG. 4 is a block diagram illustrating the signal flow in the present invention.

Referring to the trajectory of FIG. 3 and to the block diagram of FIG. 4, prior to launch of the missile, the fire control system 34 of the launch platform provides preset inputs to the missile guidance system 36 and a navigator computer 40 on board the reentry body. These preset inputs define the nominal trajectory of the reentry body including the nominal reentry time. During the missile's first or second stage burn, the navigator 40 is activated and the missile guidance system 36 sends a signal to start a flight clock 42 at a predetermined time from guidance start.

Following deployment of the reentry body, reentry occurs when $t=t_o$ in clock 42 and within the position error ellipse at approximately 400K feet. At $t=t_o$ the navigator 40 begins on-board computations and measurements which measure the actual path of the reentry body after reentry. The navigator 40 must be able to determine the path of the reentry body and control the path to a specific impact location. Based on measured acceleration from accelerometer instrumentation 44 using strapped down techniques (i.e. accelerometers are fixed to the reentry body so that the inertial acceleration vector is sensed in body-oriented axes) and the predicted reentry velocity vector, the computer 40 integrates the acceleration data to provide position and projected position of the reentry body.

The reentry body, which was spun at deployment, follows a ballistic path to approximately 200K feet where despin is initiated with despin rockets. The reentry body trajectory is controlled to a ballistic path until initiation of the dive maneuver at 100K feet or less.

Referring again to FIG. 4, a roll reference 46 is coupled to the navigator 40. A horizon sensor 48 provides the initial roll alignment before reentry for establishing the proper roll attitude for the spinning reentry body. The roll reference is transferred to a roll gyro 50 (following despin by despin rockets 51) to precluded problems associated with horizon sensors at low altitudes and in reentry heating environments. A magnetometer 52 is included to provide an initial roll reference using a different technique and also a degree of redundancy.

Figure 5:
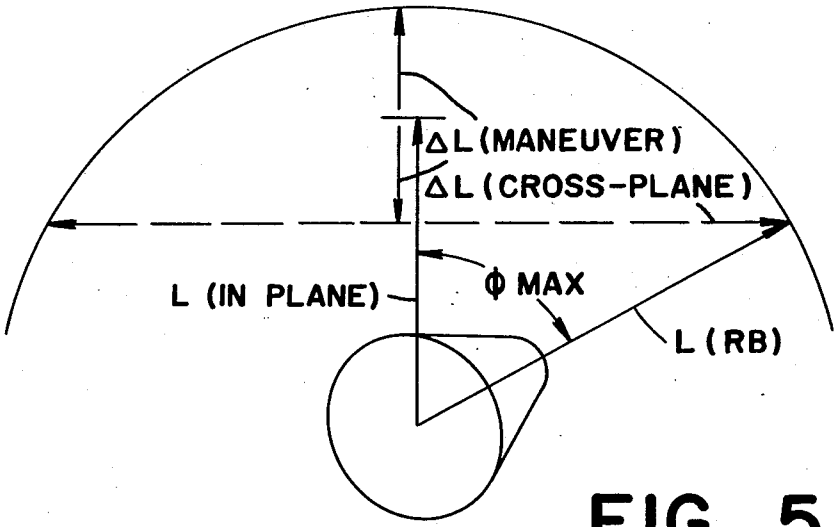
FIGS. 5 and 6 illustrate the preferred rolling technique for modulating the reentry body's lift to accomplish the diver trajectory.
Figure 6:
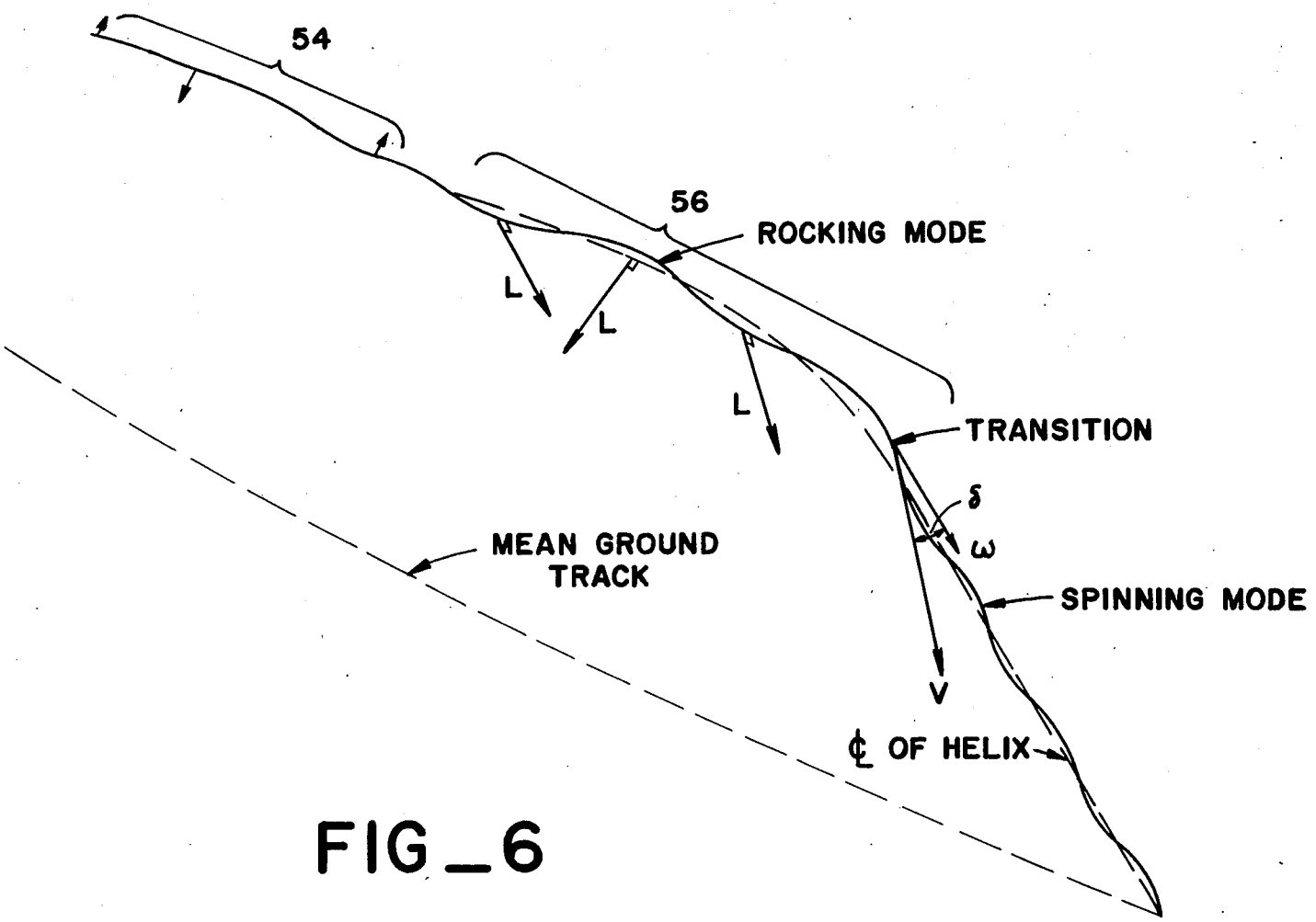

Turning now to trajectory control considerations, FIGS. 5 and 6 illustrate the preferred technique for providing the lift modulation to accomplish the desired maneuver. FIG. 5 shows the division of the reentry body aerodynamic lift force (L) that would exist if the reentry body followed a sinusoidal oscillation in roll about the maneuver plane. Taking into account the dwell time at peak roll amplitude and the rapid passage through the maximum in-plane lift condition, it can be shown that the effective in-plane maneuver lift is the average of the vertical lift at zero degrees roll angle and the maximum roll angle ($\phi$max) conditions. Trajectory control is accomplished by modulating the magnitude of the lift, L (Maneuver), during the maneuver by commanding changes in the maximum roll amplitude ($\phi$max). Thus a rocking motion is used for dive trajectory control.

FIG. 6 illustrates the trajectory control for a typical diver maneuver. Since the dive concept allows for ballistic legs of varying length following despin, the effects of reentry body lift are averaged out by restricting the lift to the lateral plane and cycling it through properly timed 180-degrees direction changes. A minimum of three separate lateral lift orientations as shown at 54 provide essentially zero cross-range error at dive maneuver initiation. Following this quasi-ballistic leg 54, the rocking motion is commanded to provide the proper lift for the dive maneuver represented at 56. The final straight leg of the dive trajectory may be achieved by a constant spin rate ($\omega$) about the reentry body longitudinal axis at the trim angle of attack.

As previously described, the precise control in the maneuver trajectory plane is achieved by employing reentry body rocking motion as a method for modulating the vertical component of aerodynamic lift. An added benefit derived from this technique is the ability to monitor continuously the magnitude of the reentry body trim angle-of-attack which is required for the zerodynamic navigation scheme. A single 2-axis roll-yaw gyro 60 (See FIG. 4) provides the sensed data for the determination of angle-of-attack.

Figure 7:
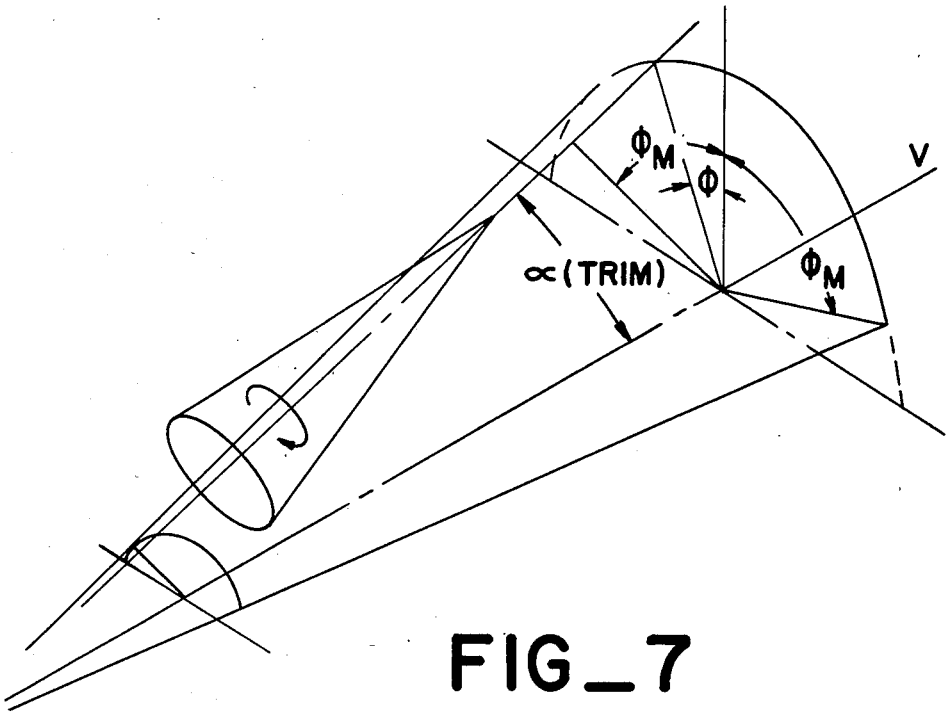
FIGS. 7 and 8 illustrate the principles employed in measuring the trim angle-of-attack during rolling flight.
Figure 8:
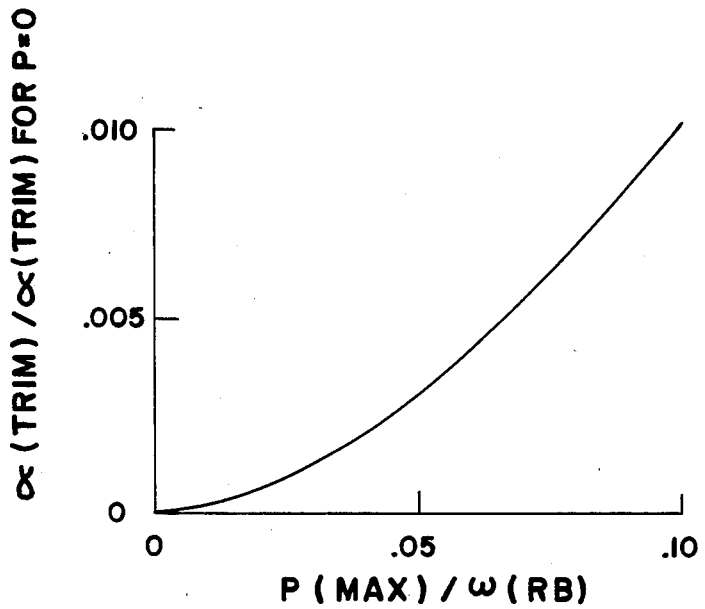

It is well known that a trimmed aerodynamic vehicle performing slow rolling maneuvers follows the motion pattern shown in FIG. 7. The principal longitudinal inertial axis about which the vehicle rolls follows the surface of a right circular cone whose half angle is the reentry body trim angle-of-attack, $\alpha$, and whose axis is the velocity vector. Under trim conditions the reentry body lift lies in the plane containing the longitudinal axis and the velocity vector. The trim angle-of-attack magnitude is influenced by the roll rate, P, as shown in FIG. 8. However for rocking conditions during maneuvers below 100,000 feet altitude, the maximum ratio of roll rate to reentry body natural aerodynamic frequency ($P_{MAX}/\omega_{RB}$) is about 0.1, producing a 1 percent change in the trim angle-of-attack. Thus under the expected rocking condition, the trim angle-of-attack is essentially unaffected. Since the body changes its spatial yaw orientation during the rolling motion, the effect will be detected by a yaw attitude gyro. The governing equations lead to the result that the yaw-gyro output mirrors the roll-gyro output but its amplitude is reduced according to the angle-of-attack. The technique is well known and has been employed in the determination of trim angle-of-attack during continuous rolling flight.

Turning now to aerodynamic considerations in view of the trajectory and navigation characteristic required by the present invention, the preferred reentry body has a lift/drag ratio (L/D) of approximately one. This low L/D ratio enhances the strapped down navigation by reducing angle-of-attack uncertainties in comparison with higher L/D ratios. The reentry body should have a maneuver lift loading factor ($\omega/C_LA$) sufficient to provide lift for trajectory shaping and reserve lift for trajectory control.

The preferred reentry body has an asymmetric forebody geometry that provides the desired trim lift and drag properties. The reentry body employs a single axis moving mass roll control (MMRC) system 62 coupled to the navigator/computer 40 for controlling the reentry body's roll to implement the required trajectory. The MMRC displaces the center-of-gravity of the reentry body by moving a control mass laterally within the reentry body. In the atmosphere, roll moments are provided by the product of aerodynamic normal force and the center-of-gravity lateral offset produced by the MMRC.

In addition to the reduction of errors due to pre-reentry properties, additional benefits are derived from the reduction of errors accured during reentry. These include reduced deployment sensitivities for reentry bodies deployed optimally, reduced wind effects, reduced inertial measurement unit drift because of the shorter downtime, and lesser dispersion from target-altitude errors. A further feature is that the reentry body retains the capability of impact at the ballistic aimpoint if the maneuvers subsystem malfunctions prior to maneuver initiation.

What is claimed is:

1. A method for compensating for pre-reentry errors generated by a weapon delivery system employing a reentry body, said reentry body having just prior to reentry an error distribution in a trajectory plane defined by a position-error ellipse and a delivery error assumed to be along a line of downrange means through said position-error ellipse, said method for compensating providing reduced impact range error dispersion over that provided by a ballistic trajectory after reentry, which method comprises:

(a) maneuvering the reentry body after reentry so that the terminal flight direction is essentially in line with the line of downrange means of the reentry body's position-error ellipse that exists just prior to reentry.

2. A method as recited in claim 1 wherein the step of maneuvering the reentry body after reentry includes:

(a) maintaining said reentry body on a ballistic trajectory for a predetermined distance after reentry; and (b) maneuvering said reentry body after said predetermined period of time so that the terminal flight direction is essentially in line with the line of downrange means of the reentry body's position-error ellipse that exists just prior to reentry.

3. A method as recited in claim 2 wherein the step of maneuvering the reentry body after said predetermined distance further includes:

(a) maneuvering said reentry body after said predetermined distance to provide a flight direction essentially in line with the line of downrange means of the reentry body's position-error ellipse that exists just prior to reentry; and (b) maintaining said reentry body on said flight direction for the rest of the trajectory.

4. A method as recited in claim 3 wherein the step of maneuvering includes a pulldown leg to establish said flight direction.

5. A method as recited in claim 4 wherein said step of maneuvering includes a pullup leg before said pulldown leg.

6. A method as recited in claim 5 wherein said pulldown leg is initiated before aerodynamic drag effects have appreciably altered the reentry body's position-error ellipse from that position error-ellipse existing just prior to reentry.

7. A method as recited in claim 6 wherein the step of maintaining said reentry body on a ballistic trajectory for a predetermined distance after reentry comprises:

(a) determining when said reentry body reaches a predetermined location on its nominal trajectory; and (b) continually determining the distance traveled by said reentry body after said reentry body reaches said predetermined location.

8. A method as recited in claim 7 wherein said step of continually determining the distance traveled by said reentry body after said reentry body reaches said predetermined location comprises:

(a) continually measuring the longitudinal acceleration of said reentry body;

(b) continually calculating the present velocity of the reentry body from said measured acceleration and present predicted parameters; and (c) continually calculating the distance traveled by said reentry body from said predetermined location from said calculated velocity.

9. A method as recited in claim 8 wherein maneuvering the reentry body is accomplished by modulating the aerodynamic lift force on the reentry body by controlling the roll attitude of the reentry body.

* * * * *